US005423486A

United States Patent [19]

Hunter

[11] Patent Number: 5,423,486

[45] Date of Patent: Jun. 13, 1995

[54] POP-UP SPRINKLER UNIT WITH FLOATING SLEEVE

[75] Inventor: Edwin J. Hunter, Rancho Santa Fe, Calif.

[73] Assignee: Hunter Industries, Inc., San Marcos, Calif.

[21] Appl. No.: 225,742

[22] Filed: Apr. 11, 1994

[51] Int. Cl.[6] ..... B05B 15/10; B05B 3/16

[52] U.S. Cl. ..... 239/205; 239/206; 239/123

[58] Field of Search ..... 239/203–206, 239/123

[56] References Cited

U.S. PATENT DOCUMENTS

| | | | |
|---|---|---|---|
| 1,853,805 | 4/1932 | Elder . | |
| 3,035,778 | 5/1962 | Kimbro et al. | 239/206 |
| 3,583,638 | 6/1971 | Eby et al. | 239/206 |
| 4,113,181 | 9/1978 | Sheets | 239/206 |
| 4,429,832 | 2/1984 | Sheets | 239/204 |
| 4,763,838 | 8/1988 | Holcomb | 239/205 |
| 4,781,327 | 11/1988 | Lawson et al. | 239/203 |
| 4,796,809 | 1/1989 | Hunter | 239/205 |
| 4,834,289 | 5/1989 | Hunter | 239/205 |
| 5,123,597 | 6/1992 | Bendall | 239/205 |

*Primary Examiner*—Karen B. Merritt
*Attorney, Agent, or Firm*—Baker, Maxham, Jester & Meador

[57] ABSTRACT

A pop-up sprinkler unit for mounting beneath the surface of a soil formation includes an outer cylindrical housing for subsurface mounting, with an inner housing carrying a nozzle and drive turbine with a protective sleeve of a grit resistant material reciprocally mounted between the inner and outer housings for extending with the inner housing up through a portion of the soil for deflecting grit from between the sleeve and housing when the inner housing and sleeve is retracted.

14 Claims, 2 Drawing Sheets

POP-UP SPRINKLER UNIT WITH FLOATING SLEEVE

BACKGROUND OF THE INVENTION

The present invention relates to sprinkler units, and pertains particularly to improvements in subsurface mounted pop-up sprinkler units.

In my prior U.S. Pat. No. 4,796,809, entitled "TWO-STAGE POP-UP SPRINKLER", I disclose a pop-up sprinkler unit designed to be mounted beneath the soil surface, with a portion that pops-up through the soil and exposes the nozzle for distribution of the water. The pop-up unit and nozzle is protected by means of a sleeve as it extends up and retracts back through the soil to a position beneath the surface of the soil when not in use, where it is covered by either vegetation or a layer of soil. The sprinkler unit was designed for use on playing fields, and is fully retractable so as not to interfere with activities on the field.

Sprinkler units which retract into a housing in the ground when not in use, and which pop-up or extend from a housing to a position above the surface of the ground when water pressure is applied, are widely used in both residential and commercial applications. The most popular presently used sprinkler units are typically mounted in a protective well or housing, such that the top of the protective well of the sprinkler unit is typically at ground surface level. Such units are satisfactory for use around the periphery of a playing field where they are in an out-of-the-way place, such that they do not interfere with activity on the playing field. However, they are not satisfactory for use on playing fields.

In many applications, such as playing fields for sports and for golf courses and the like, it is desirable that the sprinkler unit be truly beneath the surface of the soil, so that it does not become an obstacle on the playing field. It is desirable that they be covered by either sod or soil, such that they do not interfere with normal activity on the playing field.

Attempts have been made in the past to solve this problem by providing subsoil mounted pop-up sprinkler units which pop-up through the soil to expose the nozzle. One such approach is illustrated in U.S. Pat. No. 1,853,805, issued Apr. 12, 1932 to Elder, entitled "Irrigating Sprinkler Apparatus". This patent discloses an irrigating apparatus wherein the tubular nozzle is reciprocally mounted in a housing mounted beneath the soil. The tubular nozzle has an open upper end and a check valve closing the upper end until the tubular nozzle has extended to its extended position, at which a check valve opens to permit the flow of water from the upper end of the nozzle. However, the unit is subject to high wear and to jamming in the extended position. It also lacks an effective distribution nozzle and means for protectively mounting such a nozzle.

Another attempts at such devices is disclosed in U.K. Patent No. 1256534, issued to Ede, and entitled "Improvements Relating to Spray Irrigation Units And Systems". This patent discloses a pop-up sprinkler unit wherein a first sleeve extends from a subsurface housing through a top surface of soil, and a final sleeve having ports therein extends from the first sleeve to distribute water. The housing and sleeves of the unit are disclosed as constructed of a plastic, such as PVC or the like. This unit is also subject to high wear and to jamming. The unit also fails to disclose a system which provides nozzles having good distribution.

The major problem with such known devices is that dirt, sand and grit from the surrounding soil get jammed between the relatively movable portions of the unit. Sand and grit also become embedded in the cylindrical telescoping sleeves and work past the seals into the area between the sleeve and housing. This results in the sleeve being jammed into position such that it will not retract. They also are subject to excessive wear between the sleeve and housing, resulting in excessive leaking.

In my above-identified prior patent, I disclosed a pop-up sprinkler unit having a spring biased and supported stainless steel sleeve disposed between telescoping outer and inner housings to protectively shield the nozzle as it extends from and retracts into the outer housing. While my prior device solves many of the prior art problems, it is still not whole satisfactory in that it is expensive to manufacture and the sleeve fails to optimally follow and protect the nozzle.

It is, therefore, desirable that a simple, effective and inexpensive pop-up sprinkler unit for subsurface mounting be available.

SUMMARY OF THE INVENTION

It is, therefore, the primary object of the present invention to provide an improved subsurface pop-up sprinkler unit.

In accordance with the primary aspect of the present invention, a subsurface pop-up sprinkler unit includes a fixed outer housing and telescoping pop-up inner housing, with a grit resistant protective sleeve that frictionally floats between seals on the inner and outer housing and is moved by the inner housing for protectively covering the nozzle upon retraction of the nozzle into the outer housing.

BRIEF DESCRIPTION OF THE DRAWING

The above and other object and advantages of the present invention will become apparent from the following description when read in conjunction with the accompanying drawings wherein.

DETAILED DESCRIPTION OF THE PREFERRED EMBODIMENTS

Figure 1:
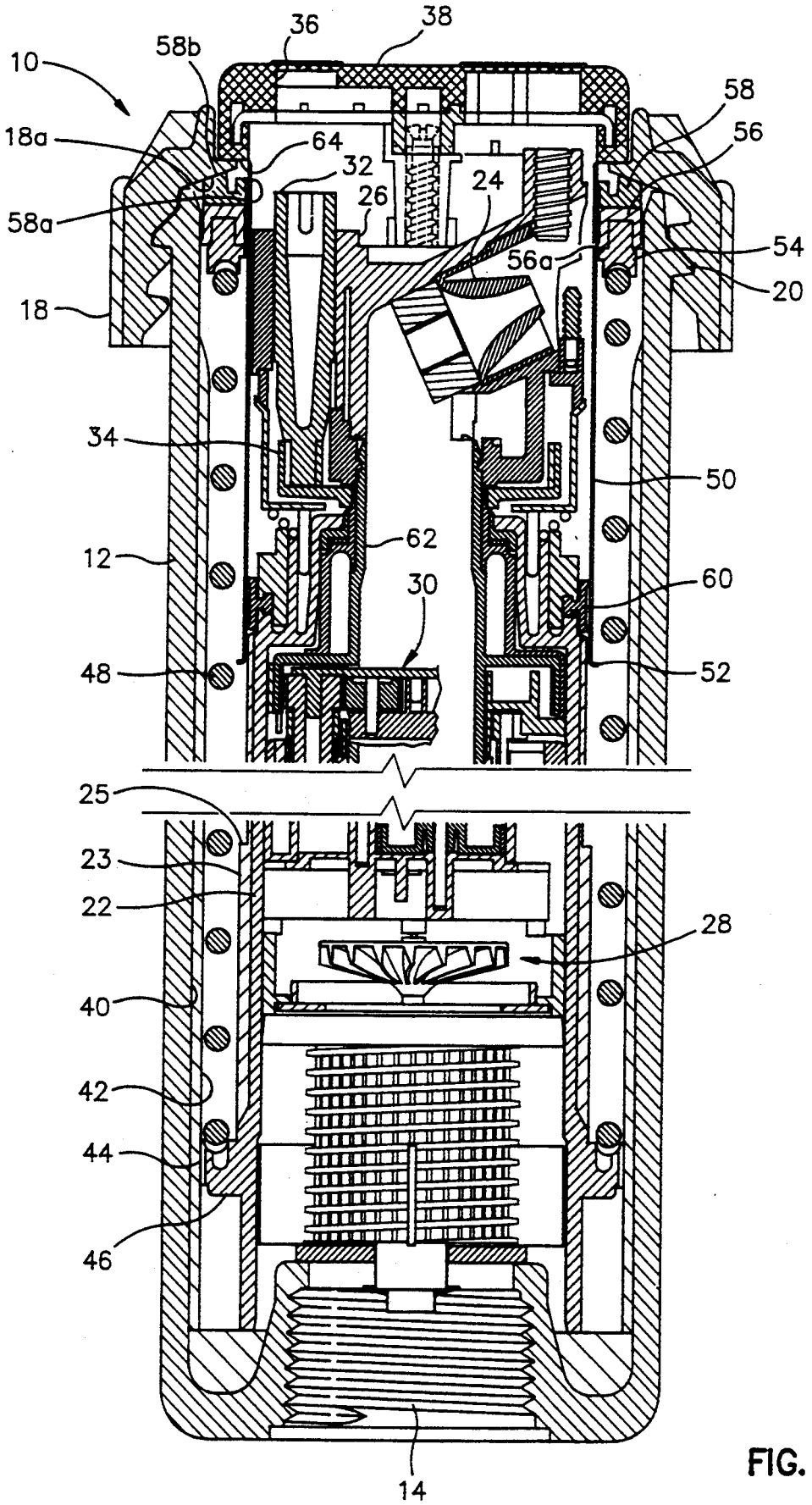
FIG. 1 is a side elevation view in section showing a preferred embodiment of the present invention.
Figure 2:
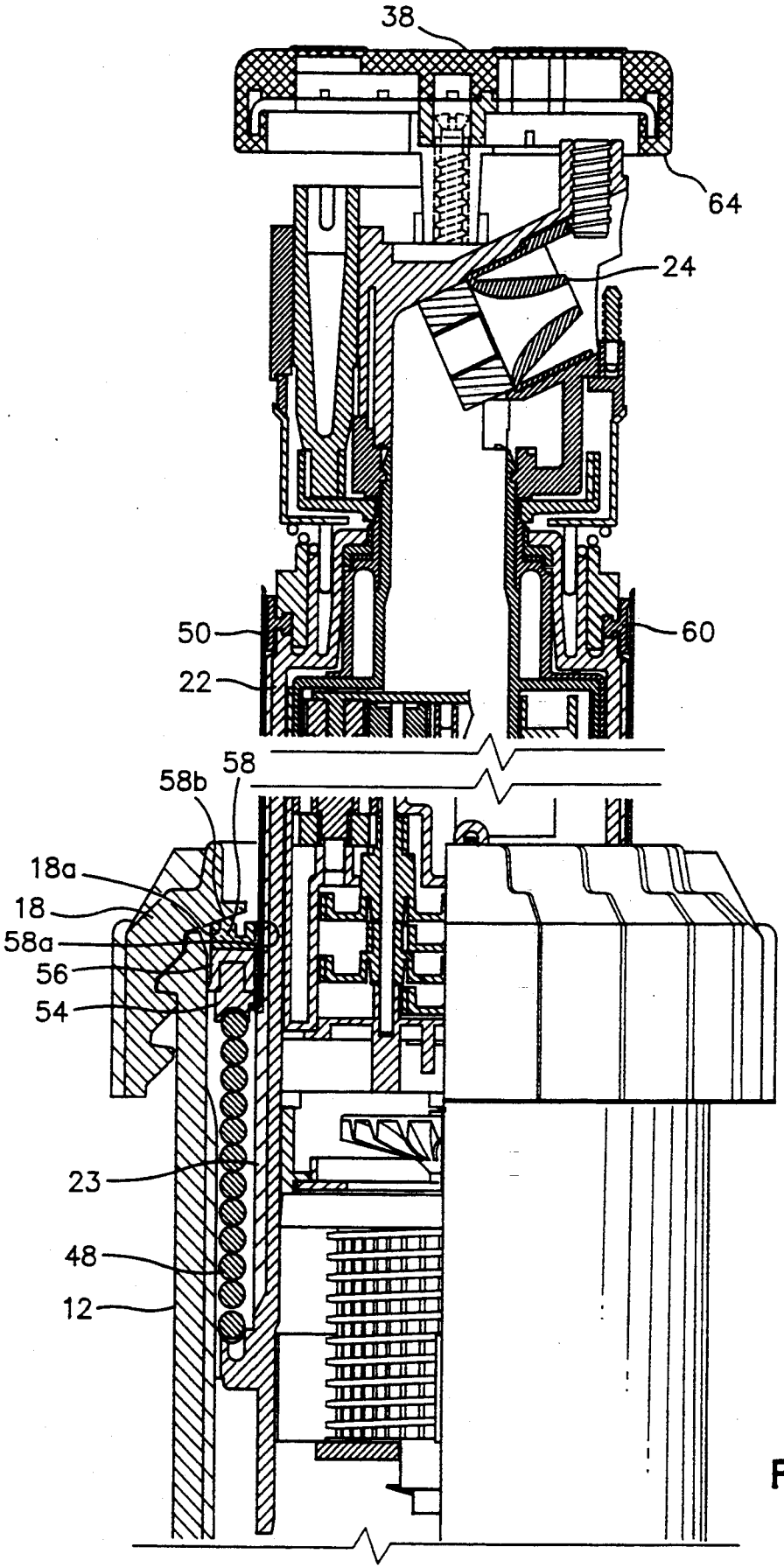
FIG. 2 is a side elevation view like FIG. 1, in section, showing the sprinkler unit in the extended position.

Referring to FIGS. 1 and 2 of the drawings, there is illustrated a pop-up sprinkler unit constructed in accordance with a preferred embodiment of the invention, shown in FIG. 1 in the retracted position, and in FIG. 2 in the extended position. The sprinkler unit, designated generally by the numeral 10, comprises a generally cylindrical outer housing 12, having an inlet opening or end 14 threaded for fitting to the end of a riser or the like for a source of pressurized water. An outlet end, which is normally oriented to be the top of the unit, is provided with a threadably mounted retaining cap 18, detachably mounted thereon by means of threads 20 in a suitable manner.

An inner tubular housing 22 is reciprocally mounted in the outer housing and supports a nozzle 24 on an upper or outer end. The nozzle is rotatably mounted in a rotatable head 26 and driven by means of turbine 28 and reduction gear drive 30, as more fully described in many of my prior patents. The particular unit illustrated is designated to oscillate within an adjustable arc, which may be adjustable by means of a rotatable shaft 32 which rotates a gear 34. The shaft 32 is rotatable by means of a tool accessible through a hole 36 in a cap 38.

The inner housing 22 is reciprocally mounted within a bore 40 of the outer housing 12, and is oriented by internal ribs 42 and by means of teeth 44 on radial flange 46. An elongated coil compression spring 48 engages shoulder or flange 46 at the lower end, and is confined within the bore by means of cap 18 at the upper end for biasing the inner housing or sleeve 22 to the retracted position.

A grit or dirt resistant tubular sleeve 50 is reciprocally mounted and floats on seals within a space between the inner housing 22 and the outer housing 12. The term "grit resistant surfaces", as used herein, means a surface having a hardness and finish, such that it will resist scratches, abrasion and embedding of fine grit or dirt particles into the surface at operating forces and pressures. This could include certain plastics, such as acetel plastics, commonly sold under the trademark Delrin, and exclude others. This sleeve, however, is preferably constructed of a sheet metal having a hard grit resistant outer surface to enable it to move through a layer of soil without grit from the soil becoming embedded therein.

The sleeve is preferably constructed of a hard and durable sheet metal, such as stainless steel, to resist not only the abrasion from grit, but also rust, corrosion and the like. The sleeve is preferably on the order of between ten and thirty thousandths (0.010 to 0.030) and preferably approximately fifteen thousandths (0.015) of an inch in thickness, and is formed with a radial flange 52 at a lower end which engages an annular ring 54 of the upper end of housing 12. This annular ring 54 biases an outer annular seal assembly comprising a seal member 56 and a combination scraper and friction ring (hereinafter "scraper" ring) 58 against cap 18 at the upper end of the cylindrical bore 40 of the housing 12.

The sleeve 50 is floatingly disposed between the inner and outer housings, and serves as a protective cover for the nozzle and upper end of inner housing 22 as it moves between extended and retracted positions. The thinness of the sleeve 50 enables the use of a nozzle and inner housing having an outer diameter almost equal to the bore of the outer housing. The sleeve need have a length only sufficient to extend between seal 56 at the upper end of the housing 12 and a seal 60 part way along the inner housing in both extended and retracted positions.

The sleeve 50 and inner housing 22 are provided with retracting means in the form of coil compression spring 48, which biases the inner housing to the retracted position (FIG. 1) when water pressure is shut off. The sleeve is frictionally supported between outer seals 56 and 58 and annular inner seal 60 near the upper end of the inner housing or sleeve 22, and frictionally engaging the inner surface of the sleeve 50. The spring 48 is positioned between the annular flange 46 and a ring 54 at the upper end of the housing 12, which biases against outer annular seal assembly members 56, 58 retained in position by the retaining cap 18. The sleeve 50 floats on and is supported by the two opposing annular seal assemblies 56, 58 and 60 between the outer and inner housings and occupies minimum space.

The upper outer annular seal assembly comprises an annular elastomeric seal member 56 of a suitable material and configuration for performing the primary sealing function. An annular combination scraper and friction ring 58 is constructed of a hard rigid plastic material, such as that available under the trademark Delrin. This scraper ring is cut or split so that it can expand and contract somewhat like a piston ring and maintain intimate contact of a scraper lip **58*a* with the outer surface of the sleeve 50. Sloping surfaces 18*a* on cap 18 and 58*b* on ring 58 act as cams under the force of spring 48, causing contracting of ring 58, thereby maintaining intimate contact and greater friction force with sleeve 50. The spring exerts more force as the spring is compressed when the inner housing is extended. The lip 58*a* of ring 58 and the aforementioned force prevents sand and grit being carried down along the outer surface of the sleeve past the ring 58. This protects seal 56** and other components within the housing against sand and grit.

The sleeve preferably protectively covers the nozzle and upper end of the inner housing as it moves through the soil into and out of the upper end of the outer housing. The inner seal 60 preferably exerts more pressure than seal 56 and scraper 58 as the inner housing begins to move outward carrying the sleeve 50 with it. Housing 22 moves upward to a first extended position, where the upper ends 25 of ribs 23 forming a shoulder 25 engage annular flange 52 at the lower end of sleeve 50. The inner housing 22 continues to move upward and carries the sleeve 50 upward to where flange 52 engages ring 54 which restrains the sleeve against further outward movement. The inner housing 22 is now at its fully extended position where the nozzle 24 is at its full height from the outer end of the sleeve 50 and is exposed, as shown in FIG. 2.

The inner seal 60 is designed to exert the least amount of frictional force to the sleeve as the inner housing 22 begins to retract inward. The seal 56 and combination scraper and friction ring 58 preferably hold the sleeve 50 in the extended position until the nozzle is retracted into the upper end of the sleeve.

The seal 56 and scraper ring 58 preferably exert the greater force at the extended position so that when the inner housing is retracting, the nozzle 24 is pulled into a protective position within the sleeve 50 as it retracts into the housing 12. When the nozzle is retracted into the sleeve 50, lower edge 64 of cap 38 engages the upper end of sleeve 50 and forces it downward to the fully retracted position. This construction forms a lost motion connection between the inner housing and sleeve, and protects the nozzle and distributor head and inner housing seals against possible entry of dirt and debris as they pass through the ground surface into and out of the housing 12.

This construction enables the inner housing 22 and nozzle 24 to extend from the upper end of the housing 12, which is buried preferably even or slightly beneath the surface of the ground. The inner housing 22 extends up from the sleeve through the soil to a position above the surface of the ground such that the nozzle can then distribute water in its selected pattern.

The inner sleeve or housing 22 carries a rotatable nozzle 24 and a drive mechanism for rotating the nozzle. The inner housing 22 is reciprocally mounted within the housing 12 and protected by the sleeve 50, and is retracted relative thereto by means of spring 48, which is a coil compression type spring. The spring 48 engages and biases between the lower radial flange 46 and an upper ring 54, which biases against seals 56 and 58 and retaining ring or cap 18. The compression spring 48 fits axially within the annular space between sleeve 50 and inner housing 22 and the outer housing 12. The sleeve 50 is essentially a protective sleeve that rides on seal 60 and on seals 56 and 58 at the outer end of housing 22.

The nozzle 24 is rotatably mounted on the upper end of inner housing 22 on satiable support structure and is normally encased within the upper end of sleeve 50. The nozzle 24 is driven by means of a turbine wheel 28, rotatably mounted within the inner housing 22 and driving through a reduction gear assembly, designated generally at 30, comprising a plurality of reduction drive gears through a tubular shaft 62 to the nozzle 24. The nozzle 24 is normally covered by or retracted within the sleeve 50 and is retained therein by means of the seals 56, 58, and 60. The seals 56 and 58 have a greater strength than that of seal 60, such that the inner housing is first extended above ground level when the upper ends of ribs 23 engage annular flange 52 and carries sleeve 50 upward when flange 52 engages ring 54 and it stops. The pressure within the system forces the inner housing 22 upward against spring 48 for extending the upper end of nozzle 24 upward beyond the upper end of sleeve 50. The nozzle is then above the surface of the ground and is exposed for operation.

A suitable cap 38 is mounted on the upper end of the nozzle 24, and has a radially and downwardly extending lip or skin 64 extending over the end of the sleeve 50 for sealing the upper end of the sleeve 50 when the nozzle is in the retracted position within the sleeve.

The sprinkler unit is designated to be buried beneath the soil a sufficient distance to avoid interference with a playing field or the like. A soil containing cup or the like (not shown) may be mounted on the top of the cap 38 for containing sod or other suitable material conforming to and providing continuity of the surrounding surface area. With this arrangement, the sprinkler unit can be mounted such that its fully retracted beneath the soil. The above combination of features, including the thin metal sleeve, enables compact and inexpensive construction of a unit.

In operation, when the sprinkler system is activated, pressurized water enters the inlet 14 at the end of the housing 12, pressurizing the interior thereof, forcing the inner housing 22 upward from the protective sleeve 50 through the soil to a position where the upper end thereof is above the surface of the formation. As the cap 38 moves away from the upper end of sleeve 50, water from nozzle 24 begins spewing out, flushing soil and sand away from the upper end of the housing. The inner housing 22 continues to move upward with the nozzle 24 beyond the end of tube or sleeve 50 to expose or uncover the nozzle and enable the distribution of water. When the water supply is shut off, the pressure within the inner housing and sleeve drops, the inner housing and nozzle 44 first retracting into sleeve 22, with should 64 engaging the upper end of sleeve 50 so that the nozzle is protectively covered and moves into housing 12.

The inner housing 22 retracts first, drawing the nozzle 24 into the sleeve 50 where it is protected. As the housing 22 and sleeve 50 are retracted further, soil and grit on the outer surface of sleeve 22 will be at least partially deflected or excluded by the deflector edge a of seal 58.

The combination of the grit deflector and hard surface construction of the sleeve 50 enables the sprinkler unit to operate indefinitely in the soil without jamming or excessive wear.

While I have illustrated and described my invention by means of specific embodiments, it is to be understood that numerous changes and modifications can be made therein without departing from the spirit and scope of the invention.

I claim:

1. A pop-up sprinkler unit for burying beneath the surface of the soil of an earth formation comprising:

an elongated outer housing member having a cylindrical through bore extending from an inlet for connecting to a source of water to an outlet end for receiving a retractable nozzle;

an elongated inner housing having an inner end and an outer end with said nozzle mounted on said outer end thereof reciprocally mounted in said bore and movable between a retracted position within said bore and an extended position wherein said outer end and said nozzle is extended from said outlet end of said bore, and said inner housing responsive to a source of pressurized water for extending to said extended position through a covering earth formation from said bore;

biasing means for normally biasing said inner housing to said retracted position; and an elongated grit resistant tubular sleeve having an inner end and an outer end mounted in said bore between said inner housing and said outer housing frictionally supported between first annular seal means at the outlet end of said outer housing and second annular seal means near said outer end of said inner housing, said second seal means has a greater frictional force than said first seal means so that said sleeve is normally carried by said inner housing for moving with said inner housing in a protective position covering said nozzle between said retracted position and said extended position.

2. A sprinkler unit according to claim 1 wherein said sleeve is formed of seamless sheet metal.

3. A sprinkler unit according to claim 2 wherein said sheet metal is stainless steel.

4. A sprinkler unit according to claim 1 wherein said sleeve has a radial shoulder at the inner end for limiting the outward extension thereof relative to said bore.

5. A sprinkler unit according to claim 4 wherein said sleeve is formed of sheet metal having a thickness of on the order of about 0.010 to about 0.030 inches.

6. A sprinkler unit according to claim 5 wherein said sleeve is stainless steel.

7. A sprinkler unit according to claim 1 wherein said sleeve is formed of stainless steel sheet metal having a thickness of on the order of about 0.010 to about 0.030 inches, has a length that is less than that of said inner housing, and has a radial shoulder at the inner end for limiting the outward extension thereof relative to said bore.

8. A pop-up sprinkler unit for burying beneath the surface of the soil of an earth formation comprising:

an elongated tubular outer housing member having a coaxial through bore communicating from an inlet for connecting to a source of water to an outlet end for receiving a retractable nozzle;

an elongated inner housing having an outer end and an inner end with said nozzle mounted on said outer end thereof and reciprocally mounted in said bore for movement between retracted position within said bore and an extended position wherein said outer end and said nozzle are extended from said outlet end of said bore, and said inner housing being responsive to a source of pressurized water for extending to said extended position; and an elongated grit resistant tubular sleeve having an inner end and an outer end mounted in said bore between said inner housing and said outer housing and carried by ribs on said inner housing for extending with said inner housing to an extended position of said nozzle through a covering earth formation from said bore, and for being held in said extended position by said outer housing when said inner housing extends to a second position wherein said nozzle is extended from said sleeve.

9. A sprinkler unit according to claim 8 wherein said sleeve is formed of seamless sheet metal.

10. A sprinkler unit according to claim 9 wherein said sheet metal is stainless steel.

11. A sprinkler unit according to claim 10 wherein said sleeve includes a radial shoulder at said inner end for engagement with said outer housing for retaining said sleeve in said extended position.

12. A sprinkler unit according to claim 8 wherein said sleeve is formed of stainless steel, has a length of less than that of said inner housing, is frictionally supported between first annular seal means at the outlet end of said outer housing and second seal means near said outer end of said inner housing, said first seal means has a greater frictional force than said second seal means so that said sleeve is normally carried by shoulders of said inner housing.

13. A sprinkler unit according to claim 8 wherein said sleeve has a thickness of on the order of about 0.010 to about 0.030 inches.

14. A pop-up sprinkler unit comprising:

an elongated outer tubular housing having a cylindrical bore with inlet means at an inlet end for attachment to a source of pressurized water and outlet means at an outlet end communicating with said bore;

an elongated inner tubular housing having a nozzle mounted on an outer end thereof reciprocally mounted in said cylindrical bore for movement between a retracted position wherein said nozzle is encased within said outer tubular housing and an extended position wherein said nozzle is cooperatively extended from said outer tubular housing;

an elongated tubular stainless steel sleeve, having a thickness of on the order of about 0.010 to about 0.030 inches, reciprocally mounted in and disposed between said outer housing and said inner housing for movement with said inner housing between said retracted position and said extended position extending from said outlet means of said bore wherein said nozzle extends from an outer end of said sleeve, said sleeve including a radial shoulder at an inner end for engagement with said outer housing for retaining said sleeve in said extended position;

an annular outer seal member surrounding and gripping said sleeve at said outlet end of said outer housing; and an annular inner seal member extending around and gripping the inner surface of said sleeve adjacent said outer end of said inner housing, wherein said sleeve has a length of less than that of said inner housing, is frictionally supported between said first annular seal member at the outlet end of said outer housing and said second seal member near said outer end of said inner housing, said first seal member has a greater frictional force than said second seal member so that said sleeve is normally carried by said inner housing.

* * * * *